US006019130A

United States Patent [19]

Rump

[11] Patent Number: 6,019,130

[45] Date of Patent: Feb. 1, 2000

[54] WATER RUN-OUT FITTING

[75] Inventor: Hanns Rump, Hausen, Germany

[73] Assignee: Rosemarie Brand-Gerhart, Hausen, Germany

[21] Appl. No.: 09/214,264

[22] PCT Filed: Jun. 25, 1997

[86] PCT No.: PCT/DE97/01316

§ 371 Date: Jan. 18, 1999

§ 102(e) Date: Jan. 18, 1999

[87] PCT Pub. No.: WO97/49875

PCT Pub. Date: Dec. 31, 1997

[30] Foreign Application Priority Data

Jun. 25, 1996 [DE] Germany ..... 196 25 252

[51] Int. Cl.[7] ..... F16K 11/00

[52] U.S. Cl. ..... 137/601; 137/607; 251/129.04

[58] Field of Search ..... 137/599, 601, 137/607; 251/129.04

[56] References Cited

U.S. PATENT DOCUMENTS

| | | | |
|---|---|---|---|
| 4,709,728 | 12/1987 | Ying-Chung | 251/129.04 |
| 5,095,941 | 3/1992 | Betz | 137/607 |
| 5,322,086 | 6/1994 | Sullivan | 137/599 |
| 5,358,213 | 10/1994 | Pilolla | 137/625.17 |

FOREIGN PATENT DOCUMENTS

| | | |
|---|---|---|
| 0245577 | 11/1997 | European Pat. Off. . |
| 3212468 | 10/1983 | Germany . |
| 4106539 | 9/1992 | Germany . |
| 9211188 | 9/1993 | Germany . |
| 9018088 | 1/1995 | Germany . |
| 4415234 | 11/1995 | Germany . |
| 2206397 | 1/1989 | United Kingdom . |
| 2248469 | 4/1992 | United Kingdom . |

*Primary Examiner*—Stephen M. Hepperle
*Attorney, Agent, or Firm*—Horst M. Kasper

[57] ABSTRACT

The invention relates to a water faucet fixture (1, 1', 1"), especially for institutional kitchens and medical establishments, whereby a hot water line and a cold water line (3, 4) open into a mixing and shut-off unit (2) with a lever for manual control, by means of which water is supplied at a certain mixed temperature and flow volume to a spout (6), whereby the water faucet fixture (1, 1', 1") comprises another feed line (5) which, while bypassing the mixing and the shut-off unit (2), allows the supply of water from at least the cold water line (3) into the spout (6). This feed line (5) can be shut off by means of an electrically actuatable valve (9) that is controlled by the sensor signal of a proximity sensor (7, 7', 7"). The proximity sensor (7, 7', 7") is located in the upper area of the fixture in such a manner that movements that serve to operate the fixture manually do not fall within its detection range (20, 20', 20"). This makes it possible to operate the fixture contact-free as well as manually. Advantageously, the fixture comprises two additional sensors (15, 16) that serve to regulate the temperature contact-free.

20 Claims, 5 Drawing Sheets

WATER RUN-OUT FITTING

TECHNICAL AREA

The invention relates to a water faucet fixture according to the generic part of Claim 1.

STATE OF THE ART

Water faucet fixtures are known that comprise a mixing and shut-off unit (combination set) with a lever for manually controlling the water flow, whereby a hot water line and a cold water line open into the mixing and shut-off unit by means of which water is supplied at a certain mixed temperature and flow volume to a spout and flows out of the outlet opening of the fixture. Such fixtures are used mainly in the private sector but also in institutional kitchens, medical establishments and public facilities. In order to prevent the waste of water in public restrooms and so as to make the facilities more hygienic, water faucet fixtures are known which can be controlled contact-free instead of by manual operation in that there is a sensor, for example, an infrared sensor, below the outlet opening for water within the hand-washing area, whereby said sensor responds to the hands being held below the fixture ready for washing and it causes water to flow for a certain time or during the presence of the hands in the vicinity of the fixture or of the washbasin. In restrooms, often only cold water is supplied by an electric valve; sometimes, hot and cold water are mixed to the desired temperature by means of a mechanical regulator. The electric valve then feeds more or less heated water to the spout.

Moreover, EP 0 245 577 discloses a water faucet fixture having a lever for manually controlling the water flow and the temperature as well as also having a sensor for contact-free demand for water flow. This fixture can be operated either manually or contact-free, so that it can be used in the private sector as well as in public facilities. In order to switch over from manual to contact-free operation, the lever is mechanically secured by means of a screw in a position in which the fixture is open for the flow of liquid. The continuous flow of liquid in this position is prevented by an electric valve which only opens the water flow when water is demanded by approximation to the sensor and thus when the sensor generates a sensor signal.

GB-A 2 248 469 discloses a water faucet fixture which comprises a shut-off unit with a manual control of the water flow, whereby a water line opens into the shut-off unit by means of which water can be supplied at a certain flow volume to a spout. The water faucet fixture comprises another feed line in the form of a bypass which, while by-passing the shut-off unit, allows the supply of water from the water line into the spout, whereby the feed line can be shut off by means of an electrically actuatable valve that is controlled by the sensor signal of a proximity sensor that is capable of detecting an object brought into its detection range.

Moreover, U.S. Pat. No. 5,322,086 describes a water faucet fixture comprising a mixing and shut-off unit with a lever for manually controlling the water flow, whereby a hot water line and a cold water line open into the mixing and shut-off unit by means of which water is supplied at a certain mixed temperature and flow volume to a spout. Moreover, the water faucet fixture comprises another feed line which, while bypassing the mixing and the shut-off unit, allows the supply of water from the water line into the spout, whereby the feed line can be shut off by means of an electrically actuatable valve.

A drawback of the known water faucet fixtures with sensor-controlled operation is that they can only be used advantageously for purposes of hand washing, while they are too inflexible for other applications, especially for use in institutional kitchens, medical establishments or in the food industry. In these sectors, a water flow that is initiated contact-free for hand-washing as well as a continuous water flow that is initiated one time for rinsing objects or for filling a container are needed at one and the same washing station, if possible. A disadvantage of the solution proposed in EP 0 245 577 is that the decision whether the fixture is to be controlled manually or contact-free already has to be made when the fixture is installed, since mechanical manipulations to the lever and to the internal water feed are necessary in order to switch over the modes of operation.

TECHNICAL OBJECTIVE

The invention is based on the objective of creating a water faucet fixture of the type described whose water flow, preferably also the water temperature, can be controlled at any point in time independently of each other, either manually or contact-free. Work in the area of the water outlet opening, for example, in the basin below it, should be possible without water flowing automatically as a result of being triggered by the sensor control.

DISCLOSURE OF THE INVENTION AND ITS ADVANTAGES

The objective is achieved in that the water faucet fixture comprises another feed line which, while bypassing the mixing and the shut-off unit, allows the supply of water from at least the cold water line into the spout, whereby the feed line can be shut off by means of an electrically actuatable valve that is controlled by the sensor signal of a proximity sensor that is capable of detecting an object brought into its detection range and in that there is another mixing unit upstream from the valve, whereby the hot-cold mixing ratio is either manually adjustable by means of a regulator located externally in the area of the water faucet fixture or else it can be regulated contact-free by means of two proximity sensors located externally in the area of the water faucet fixture.

Such a fixture allows the conventional control of the water flow and temperature by means of manual operation of the lever that controls the combination set. Furthermore, independently of that, a contact-free demand for a water flow is also possible by approaching the proximity sensor. By providing another mixing unit, whereby the hot-cold mixing ratio is either internally predefined, manually adjustable by means of a regulator located externally in the area of the water faucet fixture or else it can be regulated contact-free by means of two proximity sensors located externally in the area of the water faucet fixture, it is possible to set the water that is supplied by means of sensor control at a constant temperature or optionally to adjust the temperature to the requirements of the user. This temperature adjustment can be effected manually in that the regulator is mechanically connected to the additional mixing unit or in that the regulator emits an electric signal that controls the mixing unit. Furthermore, the temperature can also be adjusted contact-free in that the sensor signals from two sensors, one each for hot or cold water, are weighted and used to actuate the mixing unit.

Moreover, the sensor(s) and the lever for manual operation are preferably situated in the area of the water faucet fixture in such a manner that a manual activation of the lever as well as movements in the area of the outlet opening of the water faucet fixture are outside of the detection range of the sensor(s). Such a spatial arrangement of the sensor(s) with respect to the lever ensures that the automatic, sensor-controlled water flow is not activated during the normal, lever-controlled use of the fixture. The two modes of operation can thus be clearly separated from each other. For example, the detection range of the sensor for controlling the valve extends in the direction of the side facing away from the outlet opening of the fixture, for example, by situating the sensor on the top of the water faucet fixture, while the lever is situated on the front of the fixture in the area below the outlet opening. By the same token, the lever can be situated on the top of the fixture and can project forward in the direction of the water flow, whereby the sensor is located on the back of the fixture and is capable of detecting movements in the lower rear fixture area.

The sensors for controlling the mixing unit are preferably situated on the sides of the water faucet fixture. If an object approaches, for example, the right-hand sensor and triggers a sensor pulse, this causes the mixer to feed slightly hotter water into the spout. Activating this sensor again can, in turn, bring about a gradual change in the mixing ratio, for example, in fixed increments, towards a higher water temperature.

The sensors are, for instance, infrared proximity sensors with a short-range detection range. If an object comes closer to the active surface of the sensor than a certain distance, preferably not more than 30 centimeters, the sensor generates an electric signal which is used to control the valve and optionally the mixer.

In order to evaluate the sensor signal and to activate the valve and the mixing unit, there is an evaluation unit to which the sensor signal of the sensor(s) is transmitted by means of a signal line. When the evaluation unit receives a sensor signal, it causes the valve to open for a predetermined time interval and optionally changes the hot-cold water mixing ratio of the mixing unit.

In order to avoid having electric lines inside the fixture and thus the risk of their coming into contact with water, the signal line can be an optical fiber cable.

The evaluation unit is preferably configured in such a way that, every time water is demanded anew through activation of the appropriate sensor, said unit causes water to be supplied at a predefinable temperature, especially cold or lukewarm, whereby the temperature can be changed while the water is flowing out by operating the regulator or else contact-free, by means of the sensors. After the water flow has stopped, the temperature is automatically set back to the initial value. The manual control is not affected by this.

In order to prevent scalding from hot water that might still be present in the spout of the bypass of the fixture when the faucet is subsequently operated manually, after a hot water feed and before the valve shuts, the evaluation unit preferably initiates a brief afterrinsing with cold water via the additional line, which is not reflected by the lever position.

Moreover, the fixture can also be configured in such a way that it is only suitable to supply cold water, that is to say, instead of the mixing and shut-off unit, it only has a shut-off unit for supplying the cold water, which is bypassed by a bypass according to the invention, whereby the flow through the bypass can be regulated by means of a sensor-controlled valve.

BRIEF DESCRIPTION OF THE DRAWING IN WHICH THE FOLLOWING IS SHOWN

FIG. 1 a side view of a water faucet fixture according to the invention with a sensor situated on the top;

FIG. 2 a front view of a water faucet fixture to show the detection range of the activating sensor and sensors for temperature control;

FIG. 3 a side view of the water faucet fixture with a sensor located on the rear.

WAYS TO IMPLEMENT THE INVENTION

Figure 1:
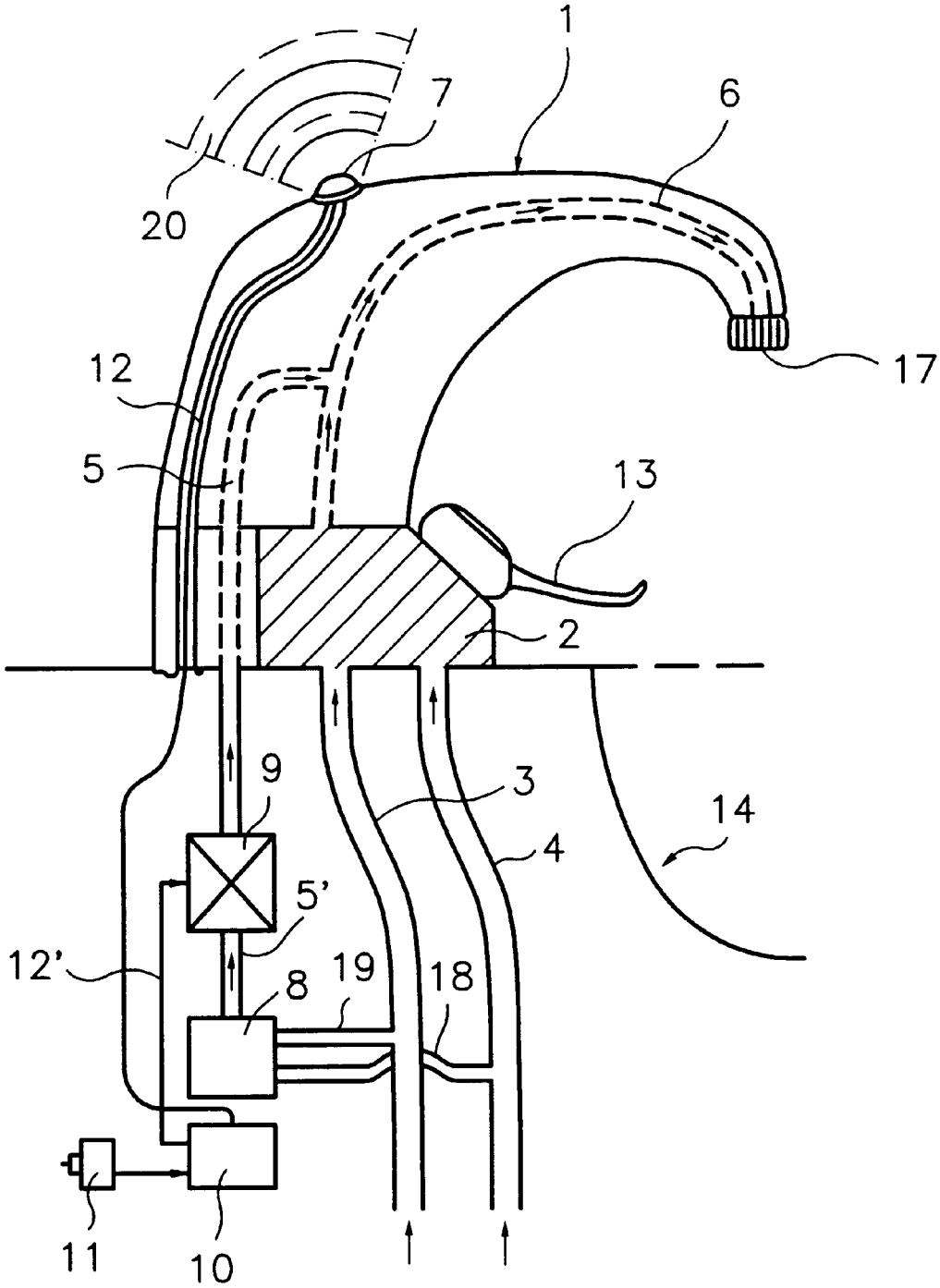

FIG. 1 shows a side view of a water faucet fixture 1 according to the invention with a sensor 7 arranged on the top, which serves for automatic, sensor-controlled activation of a water flow. The installation position of the water faucet fixture 1 on the edge of a basin or tub 14 is indicated, whereby outlet opening 17 of the fixture for the flow of water is positioned above basin or tub 14.

The lower section of fixture 1 has feed lines 3 and 4 for hot and cold water, which are connected to the corresponding lines at the installation site. Cold or heated water is supplied through these lines to a mixing and shut-off unit 2 (combination set) in which the water is mixed in a known manner and fed into a spout 6 via which it flows through outlet opening 17 into basin 14. The hot-cold mixing ratio as well as the momentary total flow volume can be manually adjusted with a lever 13, a one-hand lever. In this case, turning the lever generally brings about a temperature change by adjusting the mixing ratio, while raising or lowering the lever brings about a change in the flow volume from complete shutting off of the valve located in the combination set to complete opening of the valve with a maximum water flow volume.

In the lower area of fixture 1, upstream from the connection to combination set 2, lines 18, 19 branch off from feed lines 3 and 4 for hot and cold water, whereby said lines feed hot and cold water to another mixing unit 8. The water mixed there is fed through a line 5' to an electric valve 9 that regulates—normally shuts off—the flow from line 5' to a line 5. Line 5 opens into spout 6 of fixture 1 through which the water can flow through outlet opening 17 into the basin.

Valve 9 as well as the valve of combination set 2 is normally closed so that no water comes out of channels 5 or 6. Valve 9 can be controlled by a sensor 7 that is located on the top of the fixture. Sensor 7 is a contact-free proximity sensor, for example, an infrared sensor that responds to objects entering its detection range 20 by emitting a sensor signal. Detection range 20 is a conical area originating at the sensor surface and extending upwards with a depth of several centimeters, preferably not more than 30 centimeters. The sensor signal, an electric pulse, is transmitted via a signal line 12 of an evaluation unit 10. Said unit evaluates the sensor signal and converts it into an electric signal with which valve 9 is controlled via another signal line 12'. If the user holds his/her hand or an object within the detection range 20 of sensor 7, the latter emits a signal that is detected by the evaluation unit and converted into a control signal for valve 9. When this pulse is received, valve 9 opens for a certain time interval, as a result of which the fixture supplies water for this period of time. The water has a predefinable temperature that is set by the position of the mixing unit. The evaluation unit 10 is powered by an electric power supply 11 which is preferably a battery.

If the fixture has additional sensors for regulating the temperature of the water supplied by means of contact-free operation via the additional channel 5, then signal lines likewise lead from said channel to evaluation unit 10. Then the evaluation unit also controls the additional mixing unit 8, for which purpose signal lines 12 also have to run between these components as shown in FIG. 4.

Advantageously, fixture 1 according to the invention can be used, for example, in institutional kitchens. Here, it is possible to demand water contact-free by activating sensor 7 by placing an object within the detection range, for example, for washing hands or to pour water into a hot pan. The contact-free demand is simply effectuated by briefly holding the hands or the cookware in the area above the fixture. Such a detection range also virtually rules out inadvertent activation of the water flow as a result of accidental placement of objects within the detection range. In addition to the contact-free activation of the fixture, normal manual control of the water flow by means of lever 13 is possible at any time, for example, in order to fill the sink with water or to continuously rinse off an object.

Figure 2:
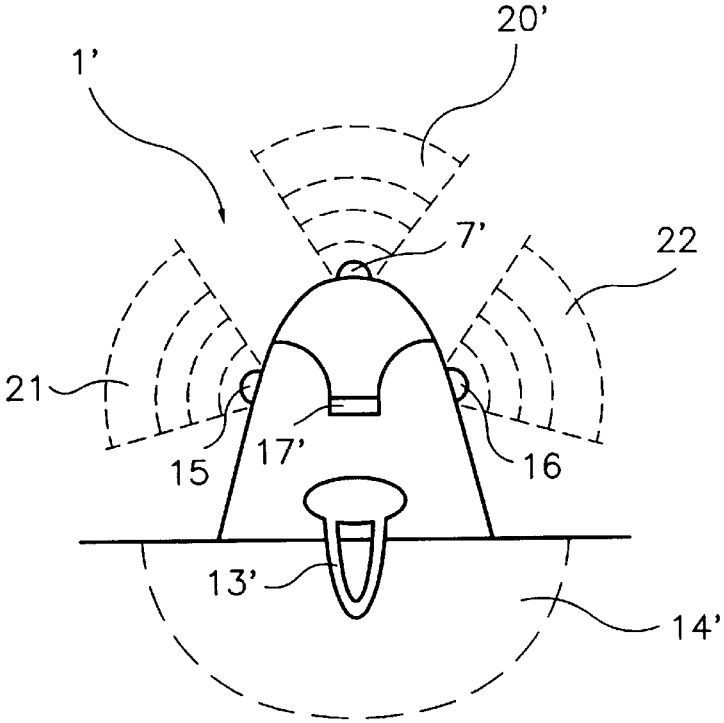
Figure 4:
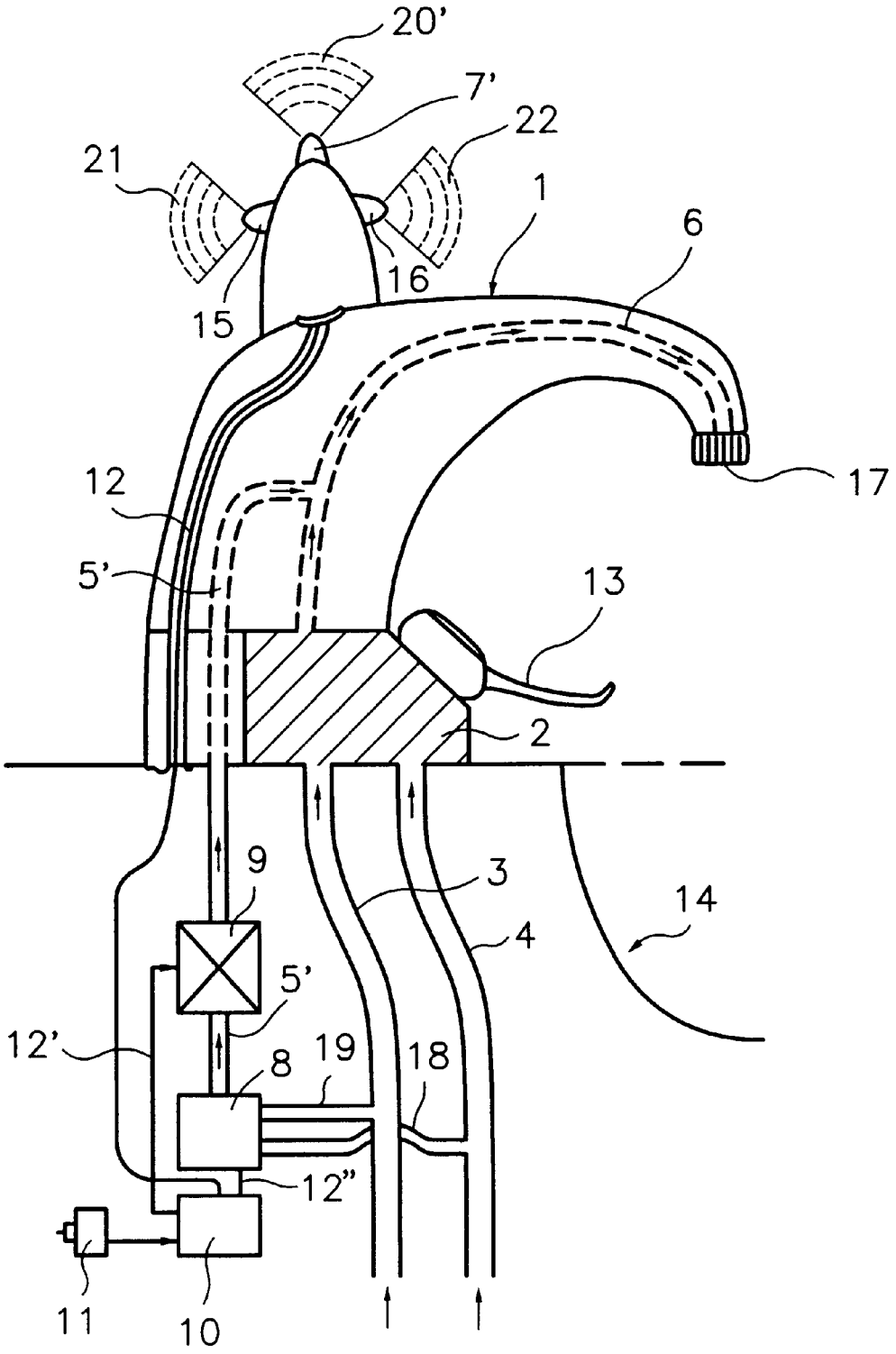
FIG. 4 is a side view of a water faucet fixture according to the invention with a plurality of sensors disposed on the top.

FIGS. 2 and 4 schematically shows a front view of a water faucet fixture 1' according to the invention with three sensors 7', 15 and 16. Sensor 7', like sensor 7 in FIG. 1, is located on the top of fixture 1' and serves to activate a water flow that has been demanded contact-free. Its detection range 20' extends from the top of the fixture upwards, so that, in order to demand a water flow, first an object has to be placed into the detection range after which water will be available outside of the detection range. Once the water flow has been activated, the water temperature can be regulated contact-free by means of two additional sensors 15 and 16. These sensors are located in the lower area of fixture 1' on opposite sides. Their detection ranges 21 and 22 face in opposite directions and neither overlaps with the other nor with the detection range of the activating sensor 7'. Thus, precise contact-free control of the water flow is possible. The sensor signals of sensors 7', 15 and 16, as described in the explanations of FIG. 1, are evaluated in an evaluation unit and converted into signals for controlling the valve (sensor 7') as well as for controlling the mixing unit (sensors 15 and 16). The fixture shown in FIG. 2 allows manual operation and control of the water flow as well as of the temperature by means of lever 13'. The sensors are arranged in such a manner that movements at lever 13' or in the basin below outlet opening 17' of fixture 1' cannot enter the detection range of one of the sensors. As an alternative, sensor 7 with the detection range facing away from basin 14' could be affixed to the rear of the fixture and lever 13' could be located on the top of the fixture. The function of sensors 15 and 16 would not be affected by this. Moreover, it is also advantageous to situate the sensors outside of the fixture, for example, on a control panel.

Figure 3:
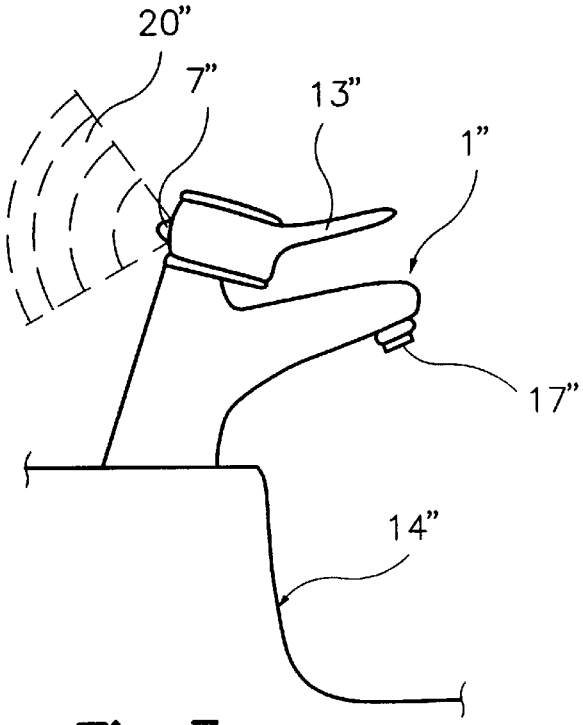

Another example of a water faucet fixture according to the invention is shown in FIG. 3, where a side view of such a fixture 1" is shown with a sensor 7" located on the rear. The water flow through this fixture 1" is controlled manually with a one-hand lever 13" installed on the top of the fixture. For contact-free activation of a water flow, there is a sensor 7" on the rear of the fixture, for example, also on the rear of lever 13". The front is the side from which the water flows out through outlet opening 17" into basin 14". This is the area where the movements take place when actions are performed in the basin, for example, for washing hands and objects, and also for the manual operation of the fixture. The detection range 20" of sensor 7" faces away from this area so that inadvertent contact-free activation of a water flow is ruled out. For contact-free operation of fixture 1" according to the invention, an object has to be briefly moved into the detection range 20" at the rear of the fixture. This is easily possible without any mechanical hindrance because such fixtures are designed to be slightly slanted in the direction of the water flow.

Figure 5:
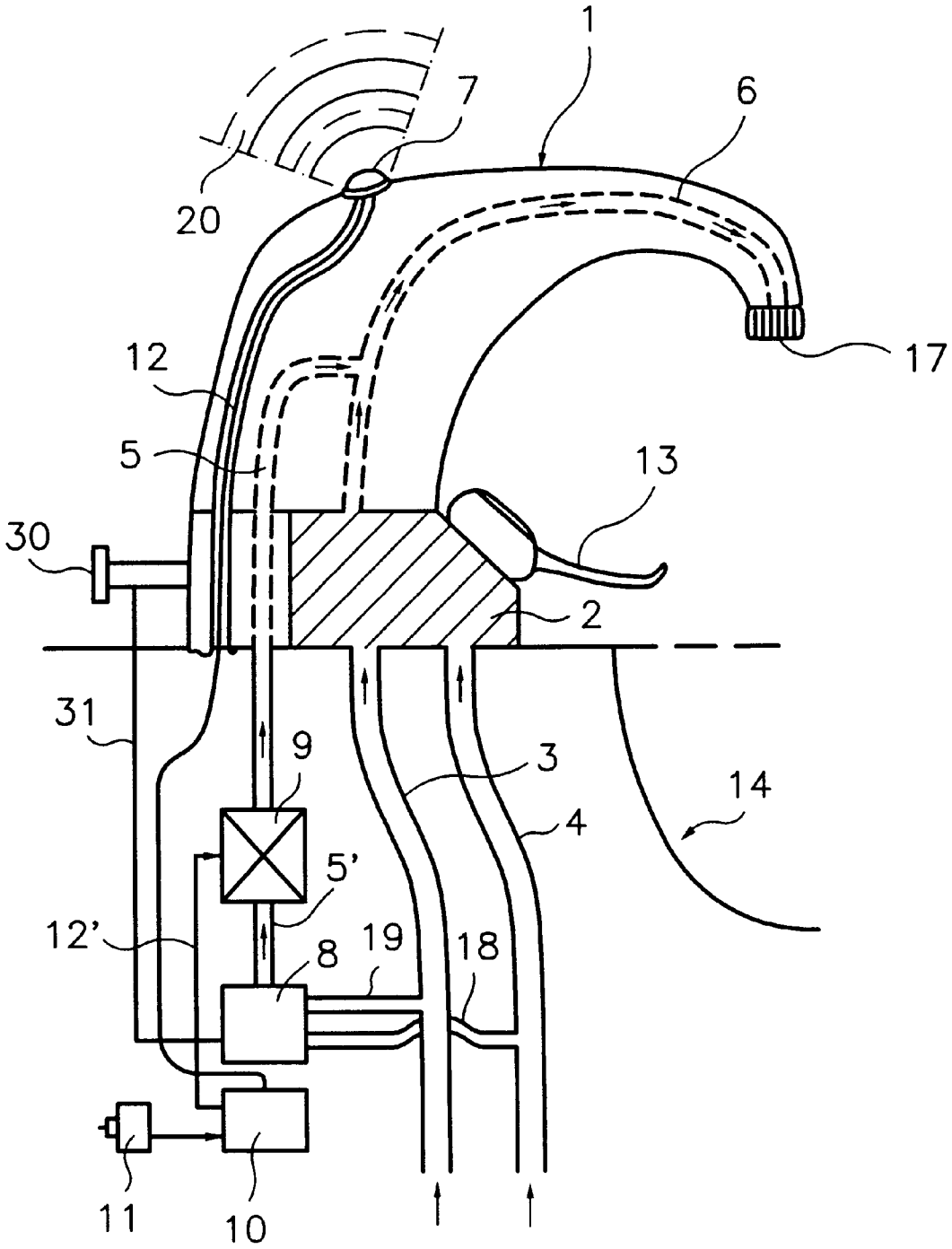
FIG. 5 is a side view of a water faucet fixture including a mechanical regulator.
Figure 6:
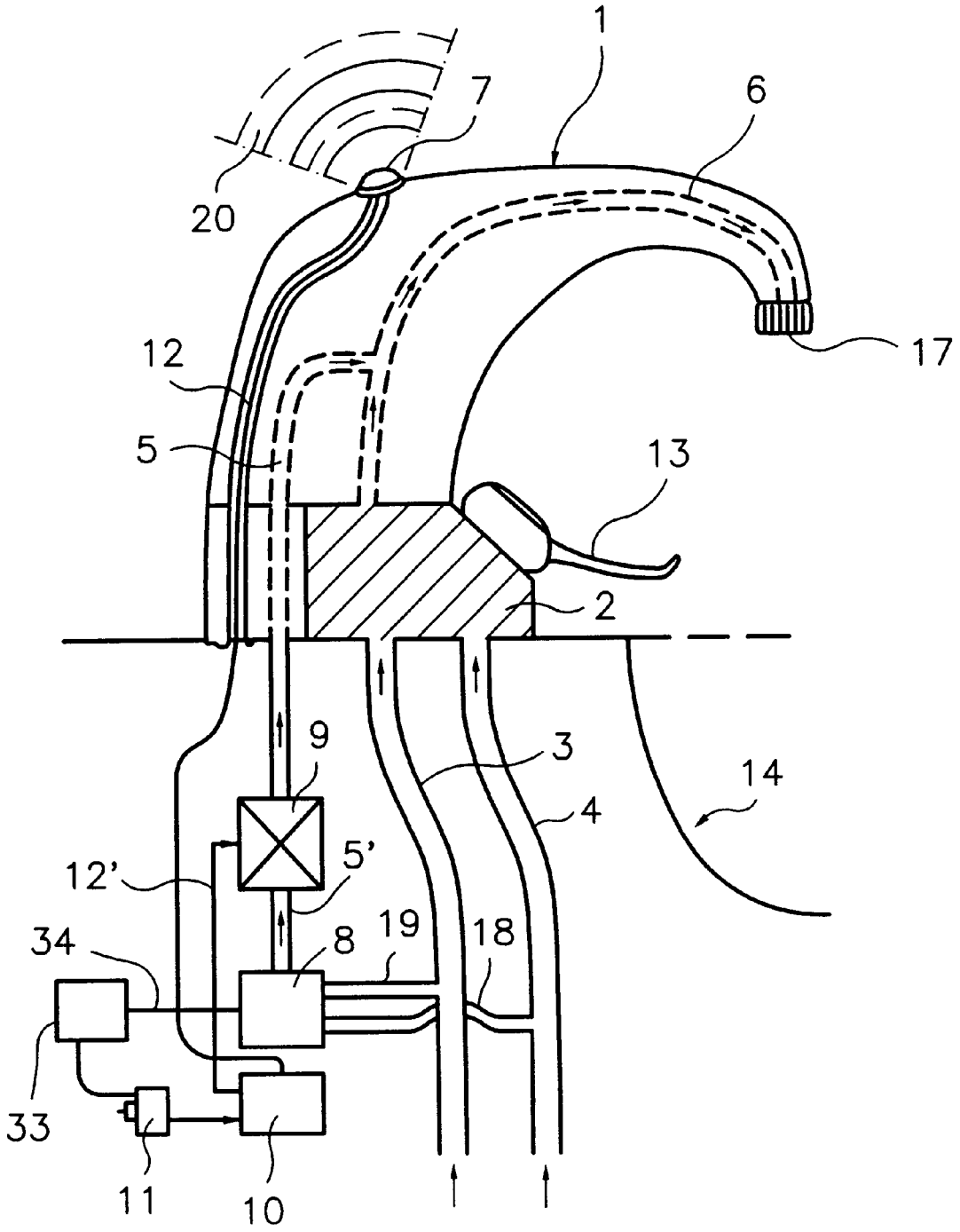
FIG. 6 is a side view of a water faucet fixture including an electrical regulator.

The hot-cold mixing ratio can be manually adjusted by means of a regulator 30 located externally in the area of the water faucet fixture, wherein a line 31 connects the regulator 30 to the mixing unit 8, as shown in FIG. 5;

The hot-cold mixing ratio can be electrically adjusted by means of a regulator 33 located externally, wherein a line 34 connects the electrical regulator 33 to the mixing unit 8, as shown in FIG. 6.

COMMERCIAL APPLICABILITY AND UTILIZATION

The invention is advantageously used in institutional kitchens, in the food industry as well as in medical establishments but also in private households where contact-free, fast demand of a brief water flow, for example, for quick, hygienic hand washing, as well as manual operation of the fixture for establishing a water flow of a certain strength, temperature and duration, for example, for filling a container or for rinsing objects, are both necessary at one and the same installation site of the fixture.

KEY TO REFERENCE NUMERALS

1, 1', 1"fixture
2 mixing and shut-off unit
3,4 cold water and hot water feed lines
5, 5', 18, 19 additional line
6 spout
7, 7", 7"' activation sensor
8 mixing unit (mechanically or electrically operable)
9 valve (electrically actuatable)
10 evaluation unit
11 power supply
12, 12' signal line
13, 13', 13" lever
14, 14', 14" basin
15,16 sensor (temperature control)
17, 17', 17" outlet opening
20, 20', 20",
21,22 detection range

I claim:

1. A water faucet fixture comprising a first mixing and shut-off unit;

a hot-water line connected to the mixing and shut-off unit and opening into the mixing and shut-off unit;

a cold-water line connected to the mixing and shut-off unit opening into the mixing and shut-off unit;

a spout attached to the mixing and shut-off unit;

a lever attached to the mixing and shut-off unit for a manual control of a water flow, wherein water is supplied at a certain mixed temperature and flow volume to the spout by means of the mixing and shut-off unit;

a feed line bypassing the mixing and shut-off unit, and allowing a supply of water from the cold-water line into the spout;

an electrically actuatable valve disposed in the feed line for shutting off the feed line;

means for adjusting the electrically actuatable valve connected to the electrically actuatable valve;

a second mixing and shut-off unit disposed in the feed line and disposed upstream from the electrically actuatable valve, and connected to the cold-water line and connected to the hot-water line.

2. The water faucet fixture according to claim 1, further comprising an outlet opening disposed in the spout for discharging a mixture of hot water and of cold water, wherein the means for adjusting the electrically actuatable valve is a proximity sensor delivering a sensor signal to the electrically actuatable valve setting a mixing ratio of hot water and cold water, wherein the proximity sensor and the lever are disposed in an area of the spout and the lever in such a manner that a manual activation of the lever as well as movements in an area of the outlet opening are outside of a detection range of the proximity sensor.

3. The water faucet fixture according to claim 2, wherein the detection range of the proximity sensor for controlling the electrically actuatable valve extends in a direction of a side facing away from the outlet opening, and wherein the lever is situated in an area below the outlet opening.

4. The water faucet fixture according to claim 2, wherein the proximity sensor for controlling the electrically actuatable valve is located in a top area of the spout and the lever.

5. The water faucet fixture according to claim 1, further comprising an outlet opening disposed in the spout for discharging a mixture of hot water and of cold water, wherein the means for adjusting the electrically actuatable valve is a regulator located externally in an area of the spout and the lever for a manual adjustment of the electrically actuatable valve setting a mixing ratio of hot water and cold water.

6. The water faucet fixture according to claim 1, further comprising an outlet opening disposed in the spout for discharging a mixture of hot water and of cold water, wherein the means for adjusting the electrically actuatable valve is furnished by two proximity sensors located externally in an area of the spout and the lever for a contact-free regulation of a mixing ratio of hot water and cold water, wherein the proximity sensors and the lever are disposed in an area of the spout in such a manner that a manual activation of the lever as well as movements in an area of the outlet opening are outside of a detection range of the two proximity sensors.

7. The water faucet fixture according to claim 6, wherein the two proximity sensors for controlling the second mixing and shut-off unit are disposed on sides of the spout and the lever.

8. The water faucet fixture according to claim 6, further comprising an evaluation unit connected to the electrically actuatable valve;

a signal line connecting the two proximity sensors to the evaluation unit, wherein the signal line transmits a sensor signal of the two proximity sensors to the evaluation unit, and wherein the evaluation unit opens the electrically actuatable valve for a predetermined time interval.

9. The water faucet fixture according to claim 8, wherein the signal line is an optical fiber cable.

10. The water faucet fixture according to claim 2, further comprising an evaluation unit connected to the electrically actuatable valve;

a signal line connecting the proximity sensor to the evaluation unit, wherein every time water is demanded anew through activation of the proximity sensor, the evaluation unit causes water to be supplied at a predefinable temperature, especially cold or lukewarm, whereby the temperature of the water discharged is changeable while the water is flowing out either by operating the regulator or else contact-free, by means of the sensors.

11. The water faucet fixture according to claim 2, further comprising an evaluation unit connected to the electrically actuatable valve;

a signal line connecting the proximity sensor to the evaluation unit, wherein the evaluation unit initiates a brief after-rinsing with cold water after a feed of hot water and before the electrically actuatable valve shuts, wherein the hot water in the spout is flushed out as a result of said after-rinsing.

12. A water faucet fixture (1, 1', 1") comprising a mixing and shut-off unit (2) with a lever (13) for manual control of a water flow, whereby a hot water line and a cold water line (3, 4) open into the mixing and shut-off unit (2) by means of which water is supplied at a certain mixed temperature and flow volume to a spout (6), and the water faucet fixture (1) comprises another feed line (5) which, while bypassing the mixing and the shut-off unit (2), allows a supply of water from the cold water line (3) into the spout (6), whereby the feed line (5) can be shut off by means of an electrically actuatable valve (9), wherein, the electrically actuatable valve (9) is controlled by a sensor signal of a proximity sensor (7) that is capable of detecting an object brought into its detection range and wherein there is another mixing unit (8) upstream from the electrically actuatable valve (9), whereby a hot-cold mixing ratio is either manually adjustable by means of a regulator located externally in an area of the water faucet fixture (1, 1', 1") or else it can be regulated contact-free by means of two proximity sensors (15, 16) located externally in the area of the water faucet fixture (1, 1', 1").

13. The water faucet fixture (1, 1', 1") according to claim 12, wherein the sensor(s) (7, 7', 71", 15, 16) and the lever (13, 13', 13") are situated in the area of the water faucet fixture (1, 1', 1") in such a manner that a manual activation of the lever as well as movements in an area of the outlet opening (17, 17', 17") of the water faucet fixture (1, 1', 1") are outside of the detection range of the sensor(s).

14. The water faucet fixture (1, 1', 1") according to claim 13, wherein the detection range of the sensor (7) for controlling the electrically actuatable valve (9) extends in a direction of a side facing away from the outlet opening (17, 17', 17") of the fixture (1, 1', 1"), and wherein the lever (13, 13', 13") is situated in front of the fixture (1, 1', 1") in an area below the outlet opening (17, 17', 17").

15. The water faucet fixture (1, 1', 1") according to claim 14, wherein the sensor (7, 7', 7") for controlling the electrically actuatable valve (9) is situated on top of the water faucet fixture (1, 1', 1").

16. The water faucet fixture (1, 1', 1") according to claim 14, wherein the sensors (15, 16) for controlling the mixing unit (8) are situated on the sides of the water faucet fixture (1, 1', 1").

17. The water faucet fixture (1, 1', 1") according to 14, wherein the sensor signal of the sensor(s) (7, 7', 7", 15, 16) is transmitted by means of a signal line (12) to an evaluation unit (10), which opens the electrically actuatable valve (9) for a predetermined time interval and optionally controls the mixing unit (8).

18. The water faucet fixture (1, 1', 1") according to claim 17, wherein the signal line (12) is an optical fiber cable.

19. The water faucet fixture (1, 1', 1") according to claim 17, wherein every time water is demanded anew through activation of the sensor (7, 7', 7"), the evaluation unit (10) causes water to be supplied at a predefinable temperature, especially cold or lukewarm, whereby the temperature can be changed while the water is flowing out either by operating regulator or else contact-free, by means of the sensors 15, 16).

20. The water faucet fixture (1, 1', 1") according to claim 17, wherein, after a hot water feed and before the electrically actuatable valve (9) shuts, the evaluation unit (10) initiates a brief after-rinsing with cold water, as a result which the hot water in the spout (6) is flushed out.

* * * * *